US008141463B2

(12) United States Patent
Lai

(10) Patent No.: US 8,141,463 B2
(45) Date of Patent: Mar. 27, 2012

(54) HAND TOOL FOR ADJUSTING TORSION

(76) Inventor: Jin-Tsai Lai, Taichung (TW)

( * ) Notice: Subject to any disclaimer, the term of this patent is extended or adjusted under 35 U.S.C. 154(b) by 310 days.

(21) Appl. No.: 12/696,007

(22) Filed: Jan. 28, 2010

(65) Prior Publication Data

US 2011/0179917 A1 Jul. 28, 2011

(51) Int. Cl.
*B25B 23/157* (2006.01)

(52) U.S. Cl. ..... 81/475; 81/467

(58) Field of Classification Search ..... 81/475, 81/472–474, 467; 408/139, 142; 173/178, 173/124; *B25B 23/157*
See application file for complete search history.

(56) References Cited

U.S. PATENT DOCUMENTS

| | | | | |
|---|---|---|---|---|
| 2,984,133 | A * | 5/1961 | Zimmerman | 81/474 |
| 4,901,610 | A * | 2/1990 | Larson et al. | 81/473 |
| 7,484,442 | B1 * | 2/2009 | Chen | 81/475 |
| 2006/0016300 | A1 * | 1/2006 | Bubel | 81/475 |

* cited by examiner

*Primary Examiner* — Monica Carter
*Assistant Examiner* — Melanie Alexander

(57) ABSTRACT

A hand tool for adjusting torsion includes a cap. A spindle assembly is fixed to the cap. A tubular adjusting seat is sleeved on the spindle assembly. The adjusting seat has a sliding groove axially spirally defined in an outer periphery thereof. At least one ball is slidably received in the sliding groove and being movable along the sliding groove. A first handle is sleeved on the adjusting seat. The first handle has a torsion spring received therein, a first teethed seat connected to the torsion spring, and a second teethed seat engaged with the first teethed seat. A sliding sleeve is sleeved on the first handle. The sliding sleeve has at least one reset slot annularly defined in an inner periphery thereof for corresponding to the at least one fixing hole. A second handle is abutted against the second teethed seat. A driving rod assembly is fixed to the second handle.

8 Claims, 6 Drawing Sheets

HAND TOOL FOR ADJUSTING TORSION

BACKGROUND OF THE INVENTION

1. Field of the Invention

The present invention relates to a hand tool, and more particularly, to a hand tool for adjusting torsion.

2. Description of Related Art

A conventional adjustable torsion hand tool in accordance with the prior art includes an inner tube. The inner tube has a groove defined therein. The front part of the groove is formed with a polygonal section. The rear part of the groove is formed with a threaded section. An adjusting screw is axially movably screwed into the threaded section of the groove. A spring seat is axially movably mounted in the groove. A spring is received in the groove. Two ends of the spring are respectively abutted against the adjusting screw and the spring seat. A polygonal head is correspondingly received in polygonal section and abutted against the spring seat. The polygonal head has a first ball and a second ball mounted therein. The first ball is abutted against the second ball. When the first ball is positioned in the polygonal head, the second ball is slightly protruded from the polygonal head and abutted against the spring seat for moving the spring seat. When the second ball is positioned in the polygonal head, the first ball is protruded from the polygonal head. A connecting rod mounted in the inner tube. The connecting rod has a pivotal portion and a connecting portion. The pivotal portion has a slot defined in a periphery thereof. The pivotal portion is pivotally received in the groove in the inner tube. The ball is abutted against the slot or detached from the groove. The connecting portion can be assembled with a tool rod having a driving portion for screwing/unscrewing a screw. An outer sleeve is sleeved on the inner tube. The outer sleeve has an adjusting hole defined therein for communicating with the groove. The spring provides different pushing forces to the polygonal head due to the position of the adjusting screw in the threaded section of the groove for adjusting a torsion value of the conventional hand tool.

However, the conventional hand tool has several defects as the following:

1. The conventional hand tool requires an external tool inserting into the inner tube and threadedly driving the adjusting screw to adjusting the torsion value. The user needs to additionally carry the external tool for adjusting the torsion value. It is quietly inconvenient. An outer diameter of the external tool must shits an inner diameter of the inner tube. Therefore, this brings some difficulties to use the conventional hand tool.

2. The conventional hand tool lacks a device for releasing the torsion power such that the spring provided for adjusting the torsion power is continuously compressed. After a long time using, the spring is metal fatigued or elastic fatigued such that the elasticity of the spring is lost such that a proper torsion power can not be reached. The user can not obviously detect that the elasticity of the spring is lost. Therefore, the failure conventional hand tool will cause damages of the equipment.

3. The conventional hand tool can not release the spring quickly. The external tool is screwed the adjusting screw to progressively release the spring. Therefore, it is inconvenient for operation and wastes the time.

The present invention has arisen to obviate/mitigate the disadvantages of the conventional torque socket assembly.

SUMMARY OF THE INVENTION

The main objective of the present invention is to provide a hand tool for adjusting torsion.

To achieve the objective, a hand tool for adjusting torsion in accordance with the present invention comprises a cap, a buckle mounted in the cap, a spindle assembly passing through the buckle and assembled with the cap. The spindle assembly includes a hollow grooved tube and an adjusting rod received in the grooved tube. The adjusting rod has one end fixed to the cap and the other end engaged with an inner periphery of the grooved tube. A tubular adjusting seat is sleeved on the grooved tube and engaged with the grooved tube. The cap is able to drive the adjusting rod. The adjusting rod is able to drive the grooved tube and the grooved tube is able to drive the adjusting seat. The adjusting seat has a sliding groove axially spirally defined in an outer periphery thereof. At least one ball is slidably received in the sliding groove and is movable along the sliding groove. A first handle is sleeved on the adjusting seat. The first handle has at least one fixing hole defined in an outer periphery thereof and extending therethrough for corresponding the at least one ball. The first handle has a torsion spring received therein, a first teethed seat connected to the torsion spring, and a second teethed seat engaged with the first teethed seat. The torsion spring has one end abutted against the adjusting seat and the other end abutted against the first teethed seat. The first and second teethed seats respectively have teeth formed thereon for corresponding to each other. The first teethed seat has one end abutted against by the torsion spring and the teeth formed on the other end correspondingly engaged with the teeth of the second teethed seat. The first teethed seat is in a polygonal shaped. A scale seat is positioned between the adjusting seat and the torsion spring. The scale seat has an indicator fixed thereon. The first handle has a scale slot defined therein for movably receiving the indicator. A transparent scale is fixed on the first handle and corresponding to the scale slot. A sliding sleeve is sleeved on the first handle. The sliding sleeve has at least one reset slot annularly defined in an inner periphery thereof for corresponding to the at least one fixing hole. A return spring is disposed between the cap and the sliding sleeve. The return spring has one end abutted against the sliding sleeve and the other end abutted against the cap for maintaining the inner periphery of the sliding sleeve abutting against the at least one ball. A second handle is sleeved on the first and second teethed seats. The second handle has a fixing seat fastened therein. The fixing seat has one end fixedly connected to a driving rod assembly and the other end abutted against the second teethed seat for positioning the second teethed seat. The driving rod assembly includes a connecting rod fixed to the second handle and a tool bit fixed to the connecting rod. The tool bit is replaceable for corresponding to the requirement. The second handle has a polygonal hole corresponding to the first teethed seat for radially fixing the first teethed seat. The second handle has three stop screw screwed in an outer periphery thereof for abutting and positioning the second teethed seat. The first handle has an outer sleeve sleeved thereon. The outer sleeve is positioned between the first handle and the second handle for covering the stop screws.

The torsion is adjustable due to rotate the cap of the present invention, without any external tool for adjusting the torsion. It is very convenient to set a torsion value. The present invention provides for releasing torsion. The sliding sleeve is axially moved for detaching the at least one ball from the sliding groove. The adjusting seat is pushed back by the elastic restoring force of the torsion spring such that the adjusting seat, the adjusting rod, the grooved tube, and the cap are pushed together to recover the state before the torsion value set for releasing the torsion spring, and preventing the torsion spring from elastic fatigued and extending operating life. The present invention provides for quickly releasing torsion. The sliding sleeve is axially moved and the at least one ball is detached from the sliding groove due to the elastic restoring force of the torsion spring for recovering the position of the adjusting seat including the adjusting rod, the grooved tube and the cap. Therefore, the torsion is quickly released to improve the conventional hand tool being progressively released and save the operating time. The present invention provides the indicator for showing the torsion value. The scale seat is pushed by the adjusting seat to drive the indicator moved relative to the scale such that the indicator can indicate the torsion value on the scale. The present invention utilizes the tool bit detachably mounted on the connecting rod such that the tool bit is replaceable due to the requirement. The hand tools necessarily carried can be decreased.

Further benefits and advantages of the present invention will become apparent after a careful reading of the detailed description with appropriate reference to the accompanying drawings.

DETAILED DESCRIPTION OF THE INVENTION

Figure 1:
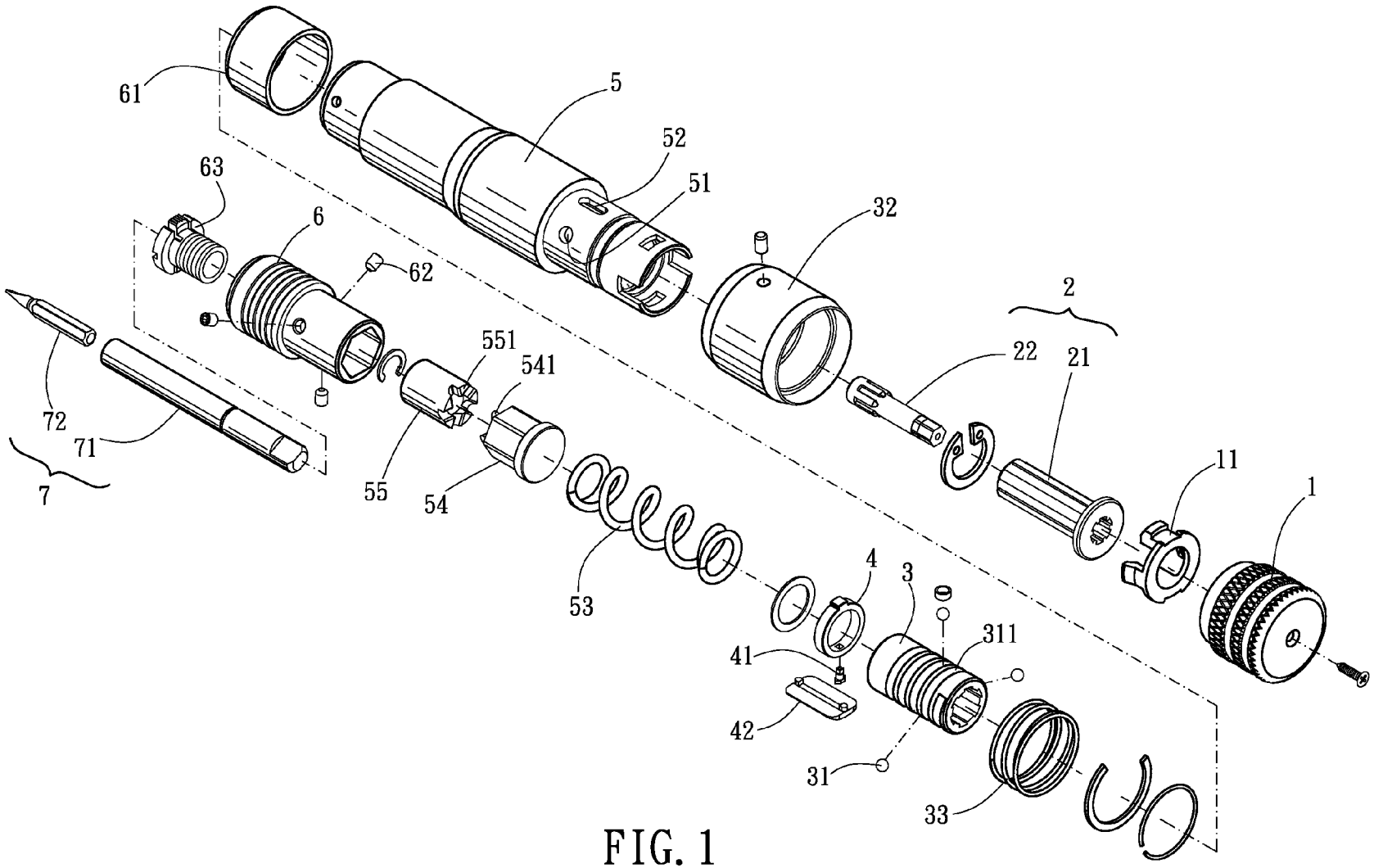
FIG. 1 is an exploded perspective view to show a hand tool for adjusting torsion in accordance with the present invention.
Figure 2:
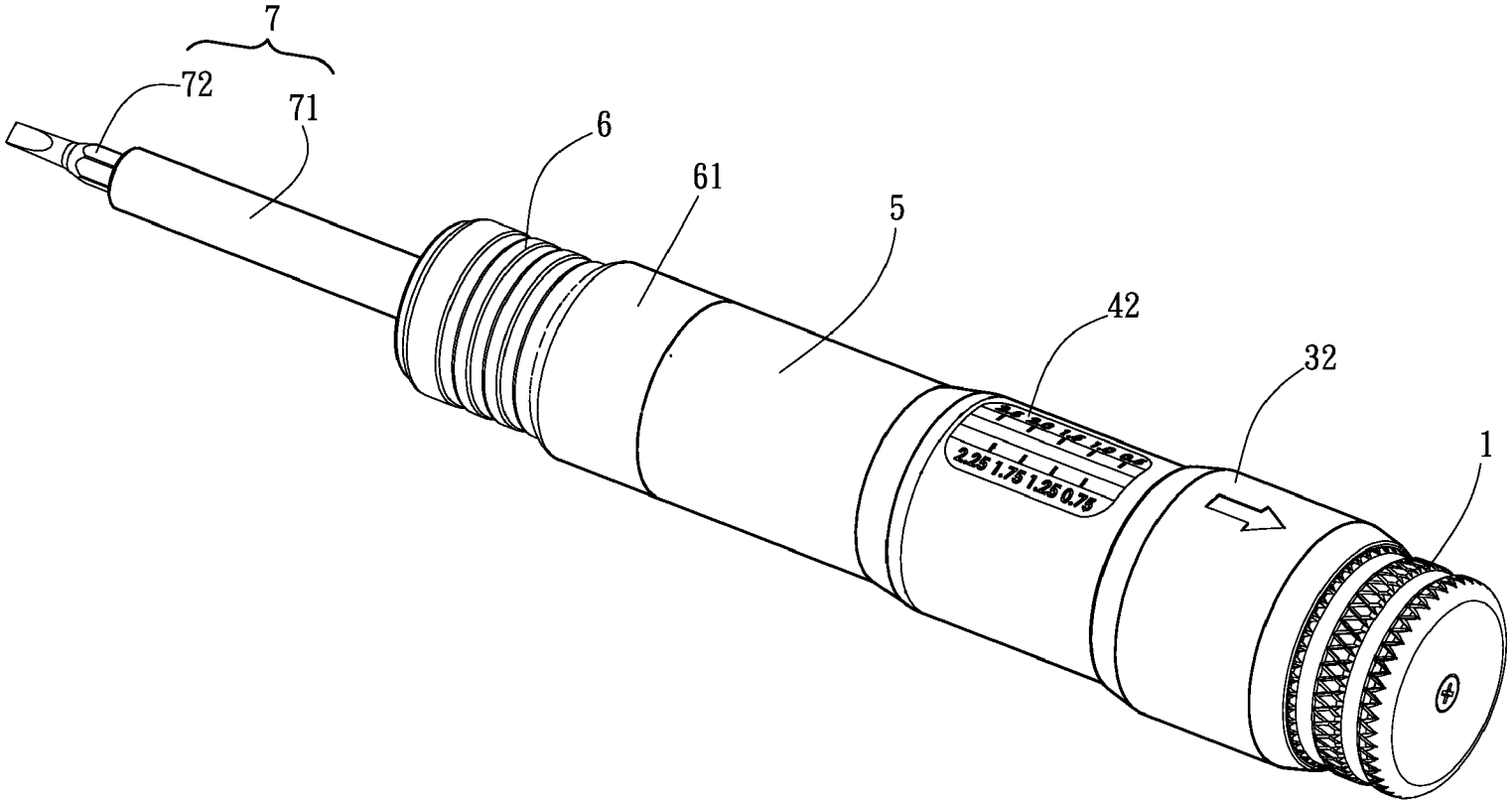
FIG. 2 is an assembled perspective view of the hand tool for adjusting torsion in accordance with the present invention.
Figure 3:
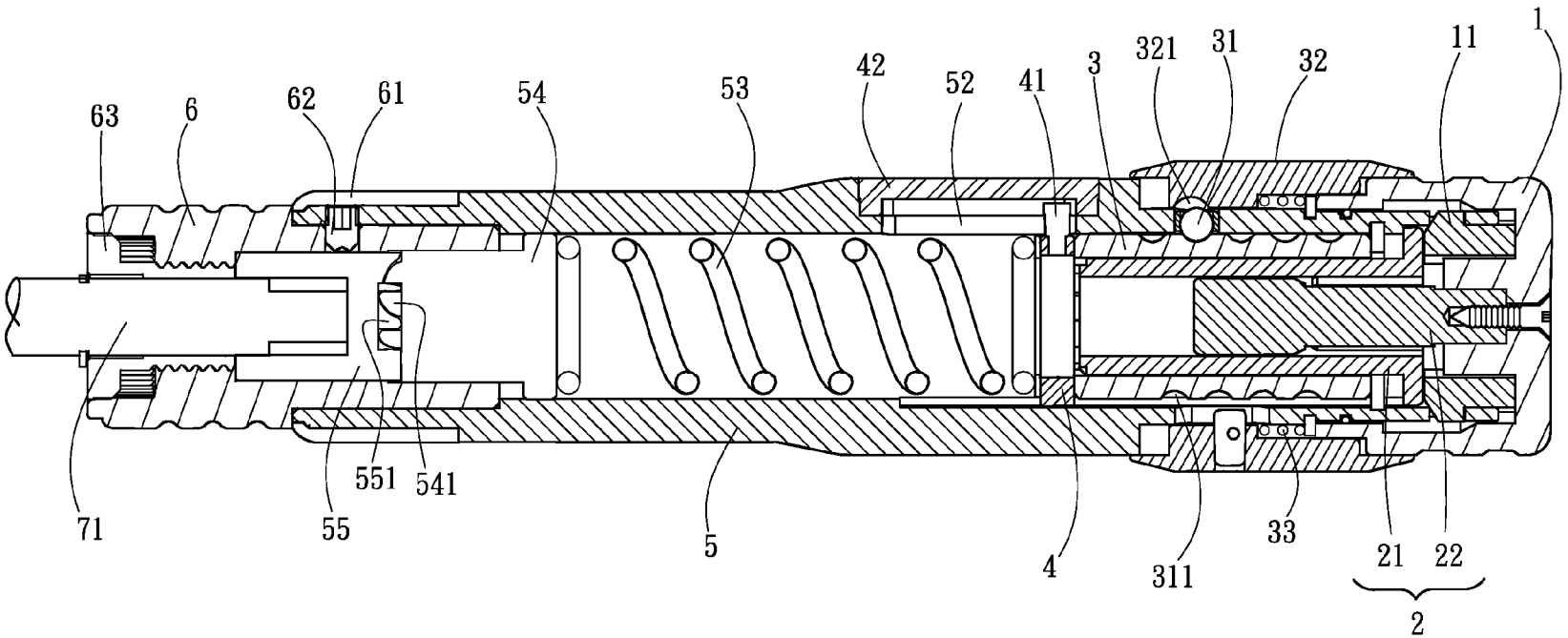
FIG. 3 is a partial cross sectional view of the hand tool for adjusting torsion in accordance with the present invention.

Referring to FIGS. 1-3, a hand tool for adjusting torsion in accordance with the present invention comprises a cap 1, a buckle 11 mounted in the cap 1, a spindle assembly 2 passing through the buckle 11 and assembled with the cap 1. The spindle assembly 2 includes a hollow grooved tube 21 and an adjusting rod 22 received in the grooved tube 21. The adjusting rod 22 has one end fixed to the cap 1 and the other end engaged with an inner periphery of the grooved tube 21. A tubular adjusting seat 3 is sleeved on the grooved tube 21 and engaged with the grooved tube 21. The cap 1 is able to drive the adjusting rod 22. The adjusting rod 22 is able to drive the grooved tube 21 and the grooved tube 21 is able to drive the adjusting seat 3. The adjusting seat 22 has a sliding groove 311 axially spirally defined in an outer periphery thereof. At least one ball 31 is slidably received in the sliding groove 311 and is movable along the sliding groove 311. A first handle 5 is sleeved on the adjusting seat 3. The first handle 5 has at least one fixing hole 51 defined in an outer periphery thereof and extending therethrough for corresponding the at least one ball 31. The first handle 5 has a torsion spring 53 received therein, a first teethed seat 54 connected to the torsion spring 53, and a second teethed seat 55 engaged with the first teethed seat 54. The torsion spring 53 has one end abutted against the adjusting seat 3 and the other end abutted against the first teethed seat 54. The first and second teethed seats 54, 55 respectively have teeth 541, 551 formed thereon for corresponding to each other. The first teethed seat 54 has one end abutted against by the torsion spring 53 and the teeth 541 formed on the other end correspondingly engaged with the teeth 551 of the second teethed seat 55. The first teethed seat 54 is in a polygonal shaped. A scale seat 4 is positioned between the adjusting seat 3 and the torsion spring 53. The scale seat 4 has an indicator 41 fixed thereon. The first handle 5 has a scale slot 52 defined therein for movably receiving the indicator 41. A transparent scale 42 is fixed on the first handle 5 and corresponding to the scale slot 52. A sliding sleeve 32 is sleeved on the first handle 5. The sliding sleeve 32 has at least one reset slot 321 annularly defined in an inner periphery thereof for corresponding to the at least one fixing hole 51. A return spring 33 is disposed between the cap 1 and the sliding sleeve 32. The return spring 33 has one end abutted against the sliding sleeve 32 and the other end abutted against the cap 1 for maintaining the inner periphery of the sliding sleeve 32 abutting against the at least one ball 31. A second handle 6 is sleeved on the first and second teethed seats 54, 55. The second handle 6 has a fixing seat 63 fastened therein. The fixing seat 63 has one end fixedly connected to a driving rod assembly 7 and the other end abutted against the second teethed seat 55 for positioning the second teethed seat 55. The driving rod assembly 7 includes a connecting rod 71 fixed to the second handle 6 and a tool bit 72 fixed to the connecting rod 71. The tool bit 72 is replaceable for corresponding to the requirement. The second handle 6 having a polygonal hole (not numbered) corresponding to the first teethed seat 54 for radially fixing the first teethed seat 54. The second handle 6 has three stop screw 62 screwed in an outer periphery thereof for abutting and positioning the second teethed seat 55. The first handle 5 has an outer sleeve 61 sleeved thereon. The outer sleeve 61 is positioned between the first handle 5 and the second handle 6 for covering the stop screws 62.

Figure 4:
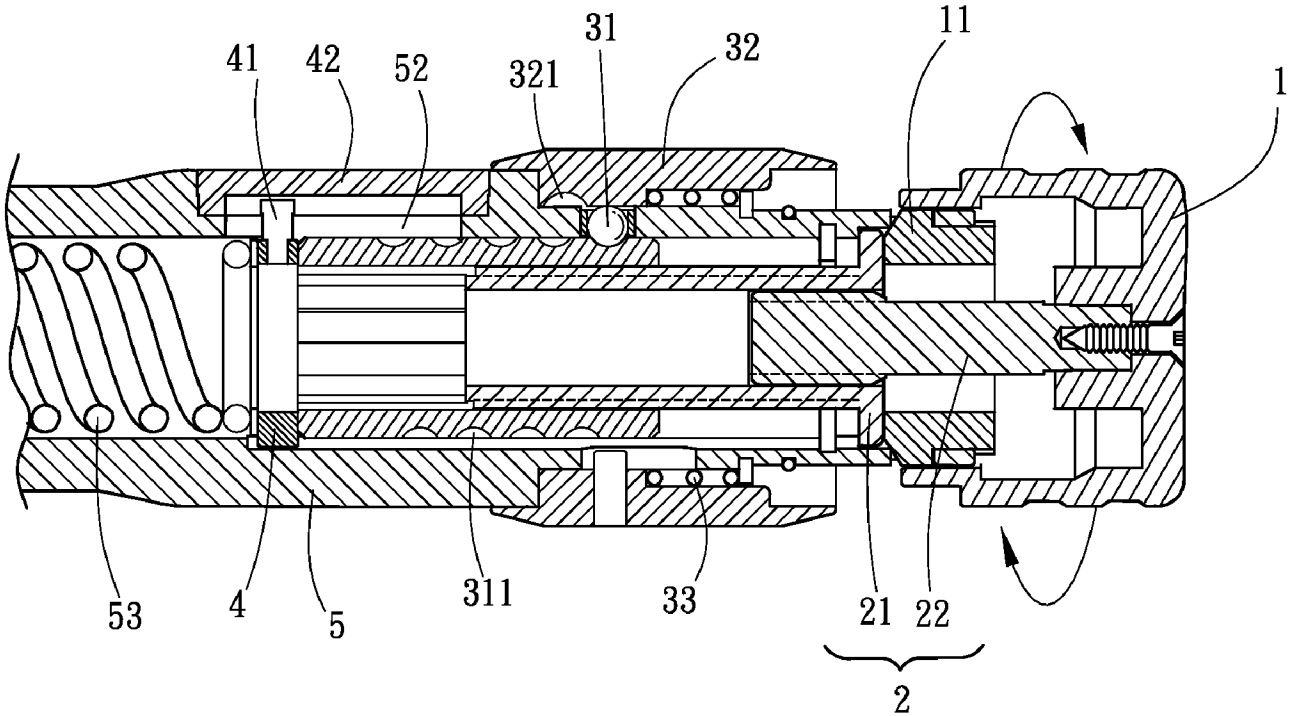
FIGS. 4-6 are cross sectional operational views of the hand tool for adjusting torsion in accordance with the present invention.

Referring to FIG. 4, the at least one ball 31 is restricted in the fixing hole 51 and the inner periphery of the sliding sleeve 32 is abutted against the at least one ball 31 such that the at least one ball 31 is received in the sliding groove 311. When adjusting the torsion value, the cap 1 is rotated and simultaneously drives the adjusting rod 22 with the grooved tube 21 with the adjusting seat 3 such that the at least one ball 31 is restricted and screwedly moved along the sliding groove 311. The adjusting seat 3 is axially moved relative to the first handle 5 for compressing the torsion spring 53 to setting torsion value. When the scale seat 4 is abutted by the adjusting seat 3 and the indicator 41 is moved relative to the scale 42. A torsion value is indicated by a position of the indicator 41 in the scale 42. When the driving rod assembly 7 is applied a force greater than the torsion power of the torsion spring 53, the diving rod assembly 7 drives the second handle 6 with the first teethed seat 54 such that the teeth 541, 551 of the first and the second teethed seats 54, 55 are slid relative to each other and the driving rod assembly 7 is idle.

Figure 5:
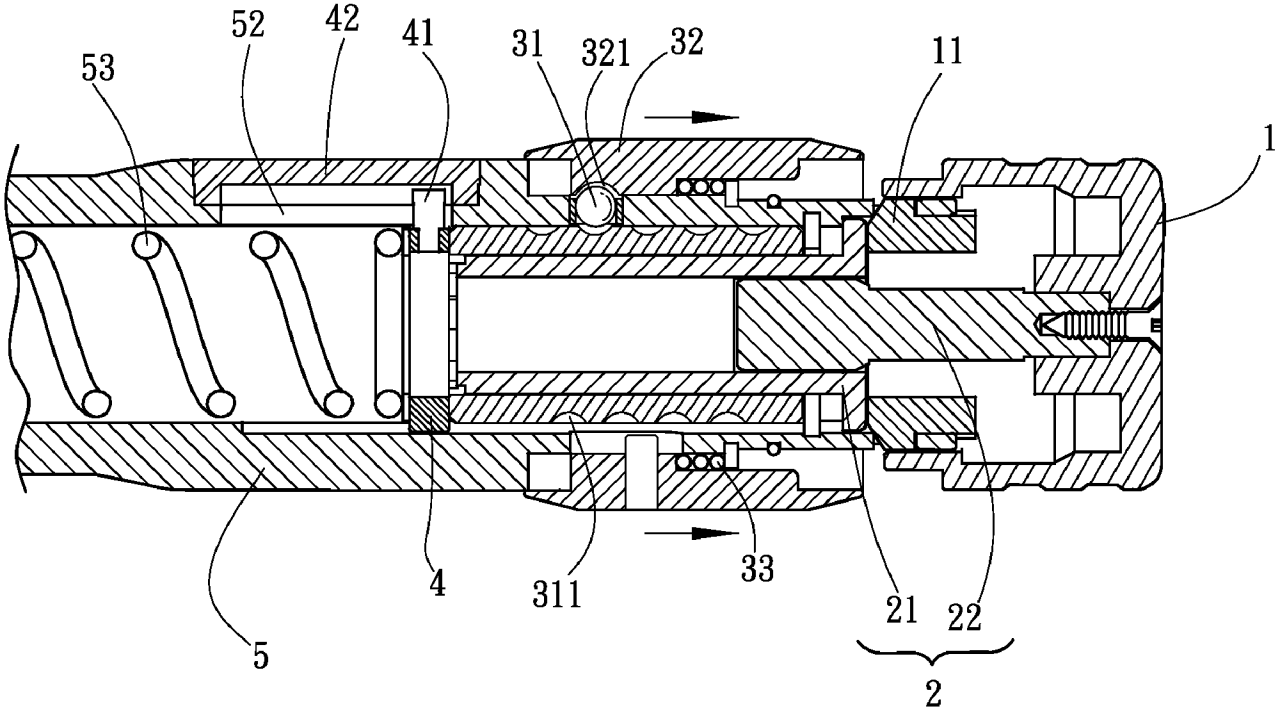
Figure 6:
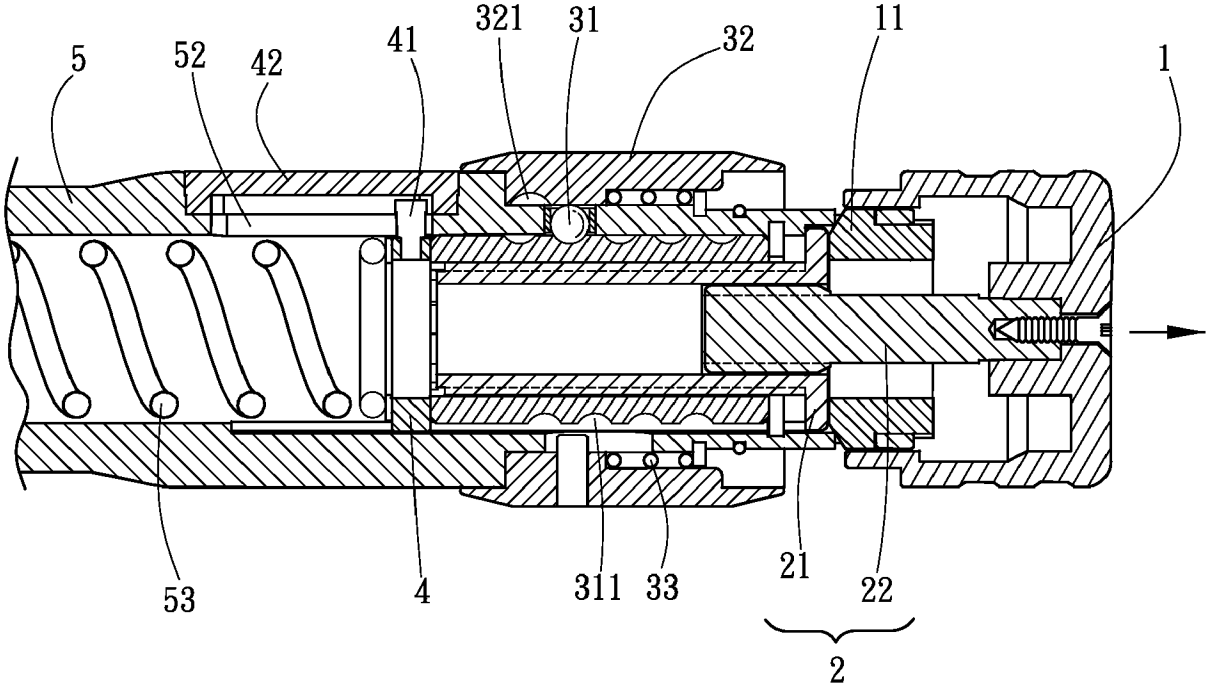

Referring to FIGS. 5-6, when the torsion spring 53 is released, as shown in FIG. 5, the sliding sleeve 32 is axially moved to compress the return spring 33 and the at least one reset slot 321 is corresponded to the at least one ball 31. The at least one ball 31 is detached from the sliding groove 311 due to an elastic restoring force of the torsion spring 53 and partially received in the at least one reset slot 321. The adjusting seat 3 is pushed by the elastic restoring force of the torsion spring 53 and moved relative to the at least one ball 31. The adjusting rod 22, the grooved tube 21 with the cap 1 are relatively moved for recovering to a state before the torsion value was set. The torsion spring 33 is released. When the sliding sleeve 32 is released, as shown in FIG. 6, the return spring 33 is abutted against the sliding sleeve 32 and the inner periphery of the sliding sleeve 32 is abutted against the at least one ball 31 such that the at least one ball is pushed into the sliding groove 311. The torsion value can be set again.

Comparing with the conventional hand tool, the present invention provides the following advantages:

1. The torsion is adjustable due to rotate the cap 1 of the present invention, without any external tool for adjusting the torsion. It is very convenient to set a torsion value.

2. The present invention provides for releasing torsion. The sliding sleeve 32 is axially moved for detaching the at least one ball 32 from the sliding groove 311. The adjusting seat is pushed back by the elastic restoring force of the torsion spring 53 such that the adjusting seat 3, the adjusting rod 22, the grooved tube 21, and the cap 1 are pushed together to recover the state before the torsion value set for releasing the torsion spring 53, and preventing the torsion spring from elastic fatigued and extending operating life.

3. The present invention provides for quickly releasing torsion. The sliding sleeve 32 is axially moved and the at least one ball 31 is detached from the sliding groove 311 due to the elastic restoring force of the torsion spring 53 for recovering the position of the adjusting seat 3 including the adjusting rod 22, the grooved tube 21 and the cap 1. Therefore, the torsion is quickly released to improve the conventional hand tool being progressively released and save the operating time.

4. The present invention provides the indicator 41 for showing the torsion value. The scale seat 4 is pushed by the adjusting seat 3 to drive the indicator 41 moved relative to the scale 42 such that the indicator 41 can indicate the torsion value on the scale 42.

5. The present invention utilizes the tool bit 72 detachably mounted on the connecting rod 71 such that the tool bit 72 is replaceable due to the requirement. The hand tools necessarily carried can be decreased.

Although the invention has been explained in relation to its preferred embodiment, it is to be understood that many other possible modifications and variations can be made without departing from the spirit and scope of the invention as hereinafter claimed.

What is claimed is:

1. A hand tool for adjusting torsion comprising:

a cap;

a spindle assembly fixed to the cap;

a tubular adjusting seat sleeved on the spindle assembly and engaged with the spindle assembly, the adjusting seat having a sliding groove axially spirally defined in an outer periphery thereof, at least one ball slidably received in the sliding groove and being movable along the sliding groove;

a first handle sleeved on the adjusting seat, the first handle having at least one fixing hole defined in an outer periphery thereof and extending therethrough for corresponding the at least one ball, the first handle having a torsion spring received therein, a first teethed seat connected to the torsion spring, and a second teethed seat engaged with the first teethed seat, the torsion spring having one end abutted against the adjusting seat and the other end abutted against the first teethed seat, the first and second teethed seats respectively having teeth formed thereon for corresponding to each other, the first teethed seat having one end abutted against by the torsion spring and the teeth formed on the other end correspondingly engaged with the teeth of the second teethed seat, the first teethed seat being in a polygonal shaped;

a sliding sleeve sleeved on the first handle, the sliding sleeve having at least one reset slot annularly defined in an inner periphery thereof for corresponding to the at least one fixing hole;

a second handle abutted against the second teethed seat, the first teethed seat correspondingly mounted in the second handle for radially fixing the first teethed seat, a driving rod assembly fixing to the second handle;

wherein the at least one ball is restricted in the fixing hole and the inner periphery of the sliding sleeve is abutted against the at least one ball; when adjusting the torsion value, the cap rotated and simultaneously driving the spindle assembly with the adjusting seat such that the at least one ball is restricted and screwedly moved along the sliding groove, the adjusting seat axially moved relative to the first handle for compressing the torsion spring to setting torsion value;

wherein when the driving rod assembly is applied a force greater than the torsion power of the torsion spring, the diving rod assembly driving the second handle with the first teethed seat such that the teeth of the first and the second teethed seats are slid relative to each other and the driving rod assembly is idle;

wherein when the torsion spring is released, the sliding sleeve axially moved and the at least one reset slot corresponding to the at least one ball, the at least one ball detached from the sliding groove and partially received in the at least one reset slot, the adjusting seat being pushed by an elastic restoring force of the torsion spring and moved relative to the at least one ball such that the torsion spring is released.

2. The hand tool for adjusting torsion as claimed in claim 1 further comprising a scale seat positioned between the adjusting seat and the torsion spring, the scale seat having an indicator fixed thereon, the first handle having a scale slot defined therein for movably receiving the indicator, a transparent scale fixed on the first handle and corresponding to the scale slot; wherein when the scale seat is abutted by the adjusting seat and the indicator is moved relative to the scale, a torsion value is indicated by a position of the indicator in the scale.

3. The hand tool for adjusting torsion as claimed in claim 1, wherein the spindle assembly includes a hollow grooved tube and an adjusting rod received in the grooved tube, the adjusting rod having one end fixed to the cap and the other end engaged with the an inner periphery of the grooved tube, the grooved tube engaged with an inner periphery of the adjusting seat; wherein when the cap drives the adjusting rod, the adjusting rod driving the grooved tube and the grooved tube driving the adjusting seat.

4. The hand tool for adjusting torsion as claimed in claim 1, wherein the driving rod assembly includes a connecting rod fixed to the second handle and a tool bit fixed to the connecting rod, wherein the tool bit is replaceable.

5. The hand tool for adjusting torsion as claimed in claim 1 further comprising a return spring disposed between the cap and the sliding sleeve, the return spring having one end abutted against the sliding sleeve and the other end abutted against the cap for maintaining the inner periphery of the sliding sleeve abutting against the at least one ball.

6. The hand tool for adjusting torsion as claimed in claim 1, wherein the second handle has three stop screw screwed in an outer periphery thereof for abutting the second teethed seat.

7. The hand tool for adjusting torsion as claimed in claim 1, wherein the first handle has an outer sleeve sleeved thereon, the outer sleeve positioned between the first handle and the second handle.

8. The hand tool for adjusting torsion as claimed in claim 1, wherein the second handle has a fixing seat fastened therein, the fixing seat fixedly connected to the driving rod assembly and abutted against the second teethed seat for positioning the second teethed seat.

* * * * *